US006126093A

United States Patent [19]

Grether et al.

[11] Patent Number: 6,126,093

[45] Date of Patent: Oct. 3, 2000

[54] FLOW REGULATOR

[75] Inventors: Hermann Grether, Müllheim; Christopher Weis, Lörrach, both of Germany

[73] Assignee: Dieter Wildfang GmbH, Müllheim, Germany

[21] Appl. No.: 09/291,156

[22] Filed: Apr. 12, 1999

Related U.S. Application Data

[63] Continuation of application No. PCT/EP97/05595, Oct. 10, 1997, and a continuation of application No. PCT/EP97/01221, Mar. 11, 1997.

[30] Foreign Application Priority Data

Oct. 11, 1996 [DE] Germany ..... 296 17 719 U

[51] Int. Cl.[7] ..... E03C 1/08

[52] U.S. Cl. ..... 239/428.5; 239/553.5

[58] Field of Search ..... 239/428.5, DIG. 23, 239/552, 553.5, 553.3

[56] References Cited

U.S. PATENT DOCUMENTS

| | | | |
|---|---|---|---|
| 2,744,738 | 5/1956 | Hjulian . | |
| 2,832,643 | 4/1958 | Bletcher et al. . | |
| 2,998,923 | 9/1961 | Aghnides | 239/428.5 |
| 4,000,857 | 1/1977 | Moen | 239/428.5 |
| 4,313,564 | 2/1982 | Shanes et al. | 239/428.5 |
| 4,365,755 | 12/1982 | Aghnides | 239/428.5 |
| 4,789,103 | 12/1988 | Ruhnke | 239/428.5 |
| 5,467,929 | 11/1995 | Bosio | 239/428.5 |
| 5,611,490 | 3/1997 | Barriac et al. | 239/428.5 |

FOREIGN PATENT DOCUMENTS

| | | | |
|---|---|---|---|
| 496033 | 9/1991 | European Pat. Off. . | |
| 0 496 033 A1 | 7/1992 | European Pat. Off. . | |
| 0 646 680 B1 | 4/1995 | European Pat. Off. . | |
| 0 721 031 A1 | 7/1996 | European Pat. Off. . | |
| 721031 | 7/1996 | European Pat. Off. . | |
| 646680 | 9/1999 | European Pat. Off. . | |
| 2562202 | 10/1985 | France | 239/428.5 |
| 1086185 | 7/1960 | Germany | 239/428.5 |
| 1 890 989 | 12/1963 | Germany . | |
| 1 193 887 | 5/1965 | Germany . | |
| 30 00 799 C2 | 7/1981 | Germany . | |
| 88 14 456 | 11/1988 | Germany . | |
| 191188 | 2/1989 | Germany . | |
| 43 33 549 A1 | 4/1995 | Germany . | |
| 830673 | 3/1960 | United Kingdom . | |
| 2 104 625 A1 | 3/1983 | United Kingdom . | |
| 2104625 | 3/1983 | United Kingdom . | |
| 4333549 | 4/1995 | United Kingdom . | |

*Primary Examiner*—Kevin Weldon
*Attorney, Agent, or Firm*—Akin, Gump, Strauss, Hauer & Feld, L.L.P.

[57] ABSTRACT

The invention involves a flow regulator (80) with a flow dispersion device (9) as well as with a flow regulation device (1) that forms the face of the flow regulator (80) which is connected downstream in the flow direction and has several flow-through holes (3). For the flow regulator according to the invention it is characteristic that the flow regulation device (1) has a perforated plate (2) on the outlet side, that has, in at least a partial area constructed as the perforated field of its planar surface that is oriented transversely to the flow direction, several flow-through holes (3) whose guide walls (4) that separate adjacent flow-through holes from each other and extend in approximately the flow direction. Each guide all has a wall thickness that amounts to a fraction of the internal hole diameter of a flow-through hole (3) limited by the guide walls (4), and that the ratio h to D between the height (h) of the guide walls and the overall diameter (D) of the flow regulation device is smaller than 1. The flow regulator according to the invention is characterized by an especially good flow formation and a high functional reliability, is where this flow regulator can be manufactured at a comparatively small expense (see FIG. 6).

24 Claims, 4 Drawing Sheets

FLOW REGULATOR

This application is a continuation of Oct. 10, 1997 application Ser. No. PCT/EP97/05595 filed and a contination of PCT/EP97/01221, filed Mar. 11, 1997.

BACKGROUND OF THE INVENTION

The invention pertains to a flow regulator with a flow dispersion device as well as with a flow regulation device that forms the face of the flow regulator on the outlet side. The outlet side has a perforated plate which is connected downstream at a distance in the flow direction and which in at least a partial area constructed as a perforated field of its planar surface that is oriented transversely to the flow direction, has several flow-through holes defined by guide walls which separate adjacent flow-through holes from each other and extend in approximately the flow direction. The guide walls each have a wall thickness that amounts to a fraction of the internal hole diameter of a flow-through hole that is defined by the guide walls. The flow dispersion device and the flow regulation device are arranged in a flow regulator housing of the flow regulator.

From European Patent EP 0 721 031 A1, a flow regulator of the aforementioned general type is already known which in its flow regulator housing has a flow dispersion device as well as a flow regulation device that is set off at a distance from it and that forms the outlet-side face of the flow regulator. While the flow dispersion device on the incoming flow side is made up of a disc which has a labyrinth-type flow conduit oriented in the radial direction to the flow-through opening, the flow regulation device on the downstream flow side is constructed as a perforated plate that has many flow-through openings. In the embodiment depicted in FIG. 22 of EP 0 721 031 A1, of the previously known flow regulator, the perforated plate is dimensioned so that the guide walls that separate adjacent flow-through holes from each other and that extend in approximately the flow direction each have a wall thickness which amounts to a fraction of the internal hole diameter of a flow-through hole defined by the guide walls.

The flow regulator previously known from EP 0 721 031 A1, however, has the disadvantage that its perforated plate that functions as a flow regulation device, and which should combine the water streams separated in the flow dispersion device after they are aerated in the flow regulator into a homogeneous soft water stream, is constructed thick by comparison. A thick perforated plate of this type makes it difficult not only to manufacture a flow regulator of this type when removing the perforated plate that is constructed as an injection molded part from the mold, and the embodiment of this flow regulator in dimensions in accordance with the standard; but also moreover, such a thick perforated plate also forms a long conduit path out of which the water streams predominately flow as individual streams.

From German Patent DE 30 00 799 C2, a flow regulator is already known that has in its flow regulator housing a flow dispersion device constructed as a perforated plate. This flow dispersion device is arranged on the outlet side after a flow regulation device. The incoming flowing water is divided up in the flow dispersion device into individual water streams which are bundled again in the flow regulation device into a homogeneous soft, bubbling water stream. Here, the flow regulation device of the previously known flow regulator is made of several wire sieves slightly offset from each other, which have a different mesh width and whose sieve openings function as flow-through holes.

The manufacture of this flow regulator sieve and its assembly in the flow regulator housing has a cost that is not insignificant. Furthermore, sieves of this type are prone to a calcification or contamination by the materials carried in the water.

From U.S. Pat. No. 2,744,738, a flow regulator is already known which has a pot-shaped flow dispersion device having several circumferential or front-side flow-through holes. The flow dispersion device is located at a distance in the flow direction downstream of a flow regulation device which consists of at least one metal sheath which is fluted in a star shape in cross-section and has a sheath opening that is oriented in the flow direction. In the center of an outer metal sheath, an additional inner metal sheath can also be arranged, which also has a fluted, star-shaped cross-section. The water stream that flows to the flow regulator in the water fitting is subdivided in the flow dispersion device into several separate streams that are then blended in the conduit channels formed between the outer nozzle and the metal sheaths with in flowing air.

The large longitudinal extension of the metal sheaths certainly causes a good flow guidance of the separate streams conducted in the conduit channels. However, at the same time, the creation of a soft, bubbling total stream is made more difficult. Furthermore, the air blending of the separate streams is in need of improvement in the flow regulation device of the previously known flow regulator. Finally, the manufacture and assembly of the flow regulator consisting of several interlocking parts require an expense that is not inconsiderable.

From British Patent GB 2 104 625 A, a mixing fitting is already known in which the hot water line and the cold water line end in a common nozzle. The nozzle has several flow-through holes which are essentially arranged on circular paths and each have a circular segment-shaped cross-section. While the flow-through holes arranged on the inner circular path, for example, are allocated to the hot water line, the cold water flows through the flow-through holes arranged on the other circular path. By the separated cold water and hot water conduit up to the nozzle, undesired cross-flows are also avoided when there are fluctuations in the water pressure. The creation of a soft bubbling water stream in the likewise comparatively high pressure nozzle of this previously known mixing fitting is in contrast, not readily possible.

From European Patent EP 0 496 033 A, one will readily recognize a flow regulator that has a flow dispersion device made of two perforated plates set off at a distance from each other in the flow direction. The outlet-side face of this previously known flow regulator is also formed here—similar to the way it is in German Patent DE 30 00 799 C2 mentioned at the beginning—by three flow regulator sieves that function as a flow regulation device. The already high manufacturing expense in the assembly of the flow regulator sieves is increased even further by the combination and alignment of the flow dispersion device consisting of two perforated plates.

The flow regulator previously known from European Patent EP 0 496 033 A has an attachment sieve as is also known in a similar form from DE 43 33 549 A. Such attachment sieves function merely as protection sieves in order to protect the flow-through openings in the flow dispersion device, as well as the flow regulation device of the flow regulator that follows in the flow direction, from a blockage by contaminant particles. In contrast with the flow regulators mentioned at the beginning, however, such attachment sieves are not allocated any flow-forming functions.

SUMMARY OF THE INVENTION

Thus, the object of the invention is to create a flow regulator of the type named at the beginning which is characterized by a good flow creation and high functional reliability and yet can be manufactured with a small expense.

The solution for attaining this object according to the invention comprises, for a flow regulator of the type noted at the beginning, in particular in that the ratio h:D between the height h of the guide walls and the overall diameter D of the flow regulation device is smaller than 3:21, and that a housing constriction is provided on the flow outlet end of the flow regulator housing behind the flow regulation device in order to bundle the flow.

The water flowing into the flow regulator according to the invention is divided in the flow dispersion device of the flow regulator into separate streams which then, possibly after being blended with air, are combined in the flow regulation device into a homogeneous soft unified stream. This flow regulation device of the flow regulator according to the invention has on the outlet side a perforated plate which has at least in one partial area constructed as a perforated field of its planar surface, several flow-through holes. Whereas traditional flow regulation sieves can at most conduct the incoming separate flow streams via the thickness of their wire diameter, the flow-through holes in the flow regulation device of the flow regulator according to the invention have a comparatively larger longitudinal extension with their guide walls so that in them the separate water streams are better able to be shaped because of the longer acting adhesion forces. Since the perforated plate, however, is also simultaneously measured in such a way that the ratio h to D between the height H of the guide walls and the total diameter D of the flow regulation device is smaller than 3 to 21, the perforated plate is constructed so thin and the guide walls are constructed so short that the formation of a soft bubbling unified stream is fostered. The good combination of the separate streams and the bundling of these separate streams into a closed cylindrical unified stream is further encouraged in that on the flow outlet end of the flow regulator housing, behind the flow regulation device, a housing constriction is provided for the bundling of the stream. Since the flow-through holes are at the same time only separated from each other by the thin guide walls, and correspondingly lie close together, the separate streams unite after passing through the flow regulation device into a bubbling-soft, homogeneous unified stream that only sprays a little. The perforated plate of this flow regulation device can be manufactured, for example, as an injection molded part or extruded part made of plastic or any other suitable material in a cost-effective manner. By its homogeneous construction, the perforated plate of the flow regulator according to the invention has less of a tendency to become calcified or contaminated due to the material contents carried in the water, so that the functional reliability of the flow regulator according to the invention is very favorable.

In order to be able to optimally form the water flow on as large a wall surface as possible of the guide walls provided in the perforated plate, preferably the perforated plate has as many flow-through openings as possible. For this, an embodiment form according to the invention provides that the flow-through holes of the perforated plate have a round, rounded, circular segment-type or angular flow-through cross section.

An additional preferred embodiment of the invention that has its own significance worthy of protection provides that the flow-through holes have at least in the central area of the perforated plate, a hexagonal flow-through cross-section and that the perforated plate is essentially constructed preferably over its entire planar surface as an essentially honeycomb cell-like perforated field. A perforated plate of this type, constructed out of hexagonal flow-through holes in a honeycomb cell-like manner, is able to shape the water stream especially well without simultaneously causing a disruptive flow resistance.

It is also possible however, that the perforated plate has, in an outer ring area, circular segment shaped flow-through holes, such that this outer ring zone circumscribes a perforated field constructed in a honeycomb-like manner and having flow-through holes that are hexagonal in cross-section.

The combined flow of the separate streams emerging from the flow regulation device into a homogeneous unified stream is essentially favored when the outlet side edges of the guide walls surrounding the flow-through holes are rounded.

The perforated plate of a flow regulator according to the invention can be connected after any traditional flow dispersion system. For use of such flow dispersion systems, in which the speed of the incoming flow of water is less greatly reduced when it is divided up into the separate streams, it is preferred if the flow regulation device has a flow regulator sieve or several flow regulator sieves, which are connected before the perforated plate on the incoming flow side. By the use of an outlet side perforated plate in the flow regulation device of the flow regulator according to the invention, not only can the result of the flow formation be improved, but also the number of the required flow regulator sieves can be reduced, which considerably simplifies the manufacture of a flow regulator of this type.

In order to reduce the manufacturing expense even further, it can be advantageous if the perforated plate is an integral component of a flow regulator housing and if the perforated plate is functionally connected as a single piece with the flow regulator housing. For an embodiment of this type, the perforated plate is provided having a positioning opening, on the one element of the flow regulator, into which a positioning projection provided on the other element can be inserted. In a central arrangement of the positioning opening as well as the positioning projection acting together with it, the two insert parts can be practically arranged coaxially to each other. In this way it can be advantageous if at least one spacer is provided at the same time as a positioning projection or as an ejector point or as an molded-on ejector part. In order to also be able to place the perforated plate exactly opposite a prior-connected element of the flow regulator in the circumferential direction, the positioning opening can have a nonround internal cross-section, onto which the positioning projection is form-fit.

An especially advantageous embodiment according to the invention provides that the flow regulation device has stays or pins running crosswise to the flow-through direction, which are connected before the perforated plate of the flow regulation device. The speed of the separate streams flowing out of the flow dispersion device can be effectively reduced between the stays or pins running crosswise to the flow-through direction in order to then bundle them in the perforated plate, connected downstream in the flow direction, into a soft homogeneous unified stream. In this way, the stays or pins running crosswise to the flow-through direction tend to calcify less than occurs in traditional flow regulator sieves, especially at the intersection points of the grid network structure of the individual sieves. Using the stays or pins oriented crosswise to the flow direction, a sufficient preliminary flow regulation can also be obtained with high liter outputs, in order to ensure a noise development that is in accordance with standard.

Especially for a flow regulator having air suction, an especially good and effective flow regulation can be obtained, when, in particular, pins arranged parallel to each other are preferably arranged next to each other in a grid-shaped manner in at least one plane that is oriented crosswise to the flow-through direction, and when in particular, several pin layers are arranged above each other in planes at distances from each other in the flow direction. While in this way, the pin layers facing the flow dispersion device stall the individual streams generated by the flow dispersion plate, in order to blend air, the pins can be set apart from each other at distances in a pin layer on the outflow side such that a function-impairing calcification is provided and possibly, a water layer that closes the flow regulator can form, by which an air seal can be obtained that also prevents calcification on the pin layers that are connected on the inflow side.

A preferred embodiment, which is characterized by an especially effective flow conductance and flow pre-regulation, provides that at least two adjacent pin layers having laterally offset pins arranged crosswise to the flow-through direction and that the pins of the pin layer arranged downstream are arranged in the flow path formed by the pins of the adjacent upstream pin layer. Thus, a controlled and uniform flow regulation is encouraged, when the separation distance of adjacent pins of a pin layer is equal.

It is advantageous when the separation distance of adjacent pin layers arranged on the incoming flow side is smaller than the separation distance of adjacent pin layers arranged downstream and when the pin layer located on the outlet side has pins with a center distance from each other, and from pins of the adjacent pin layer, of preferably more than 0.8 mm.

In order to promote an acceptable level of noise development of the flow-out device, it can be advantageous when the pins have a rounded or similar flow-encouraging cross-section profile and preferably a circular cross-sectional profile or an oval, tear-shaped, or similar oblong cross-sectional profile with its longer cross-sectional extension in the flow-through direction.

An especially effective flow pre-regulation can be obtained when several pin layers, preferably three pin layers are located before the perforated plate of the flow regulation device.

It is preferable when the throughput openings in the flow dispersion plate are constructed to narrow in a conical manner in the flow-through direction and preferably have on the incoming flow side an intake radius or intake cone. By this intake radius or intake cone, an undesired stall of the flow is counteracted. The conically narrowing embodiment of the flow-through openings in the flow dispersion plate encourages a clear sharp water stream whose speed is reduced in the area of the pin rows and that can be well enriched with air.

An effective and compact embodiment of the flow regulation device is promoted when the pins of the first pin layers on the incoming flow side are arranged approximately in the flow direction to the hole axes of the flow-through openings in the flow dispersion plate.

Additional characteristics of the invention are provided in the following description of a preferred embodiment according to the invention. The individual characteristics can each be made by themselves, or in groups, in an embodiment form according to the invention.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
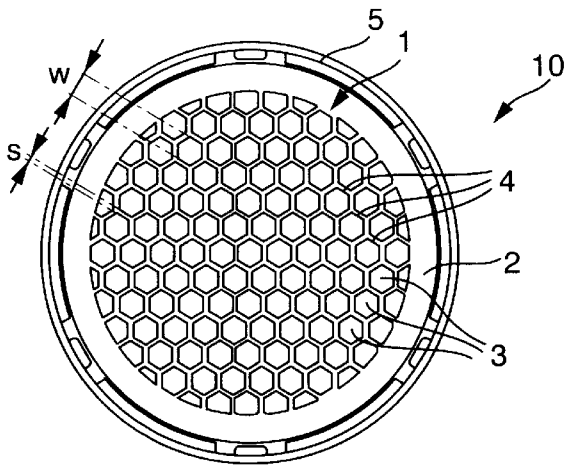
FIG. 1*a* is a bottom view of the outlet opening of a flow regulator.
Figure 1B:
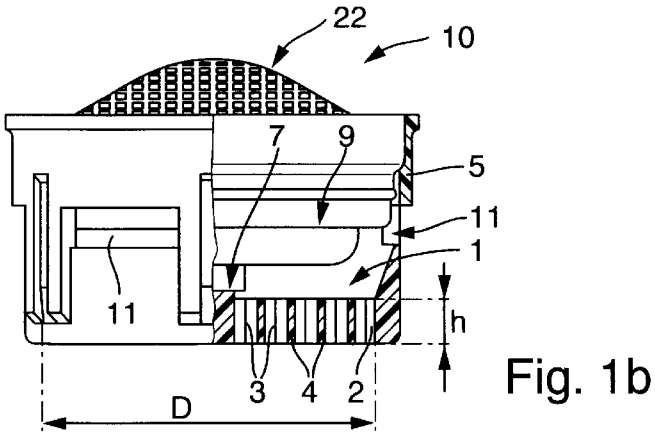
FIG. 1*b* is a partial longitudinal section, where the flow regulator has a flow dispersion device which is connected to a flow regulation device constructed as a honeycomb cell-type perforated plate and is connected as one with the flow regulator housing.

In FIG. 1 to 6, different flow regulators are depicted in different embodiments. These flow regulators can be inserted in an outlet nozzle that is not depicted here, which can be mounted to a sanitary outlet fitting.

The flow regulators 10, 20, 30, 40, 70 and 80 depicted in FIG. 1 to 6 have a flow regulation device 1 which has a perforated plate 2 on the outlet side. The perforated plate 2 is essentially constructed in a honeycomb cell-like manner over the entire planar surface oriented crosswise to the flow direction.

As is clear from FIG. 1*a* to 4*a*, the honeycomb cell structure of the perforated plate 2 used in the flow regulators 10 to 80 is made up of several flow-through openings 3, whose guide walls 4 bordering each other and extending in approximately the flow direction each have a wall thickness s, which amounts to a fraction of the internal hole diameter w of a flow-through hole 3 bordered by the guide walls 4. Therefore, the outlet side face of the flow regulators 10 to 80 is formed essentially by the perforated plate 2. The guide walls 4 are constructed on their incoming flow side having sharp edges; on the outlet flow side, the guide walls are rounded or beveled in order to encourage the combining of the water streams.

Figure 5:
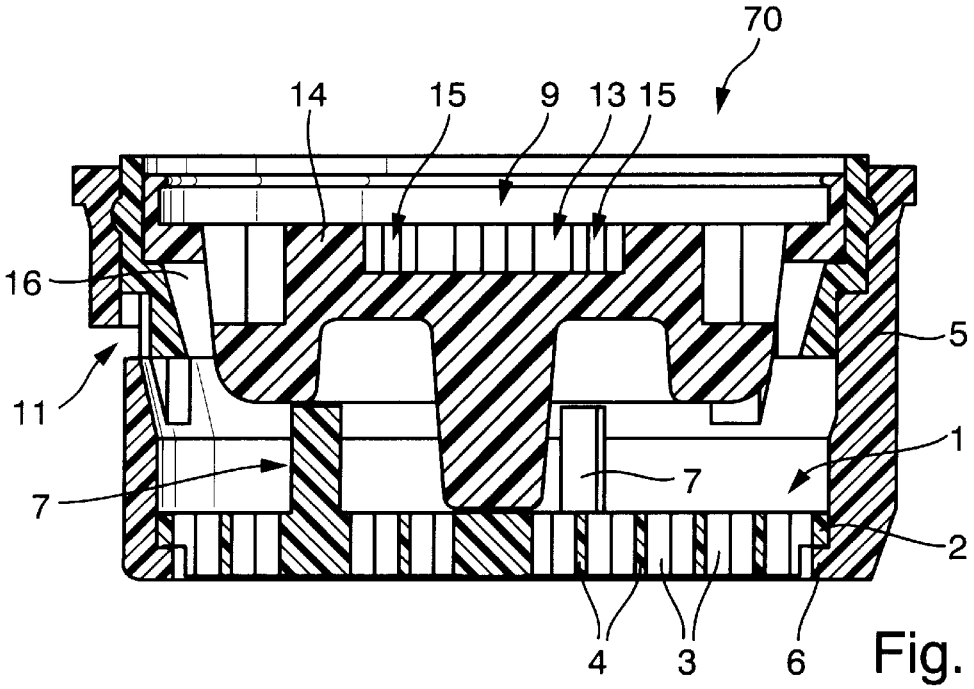
FIG. 5 is a longitudinal section of a flow regulator which has a flow dispersion device and, on the outlet side, a honeycomb-like perforated plate functioning as a flow regulation device.
Figure 6:
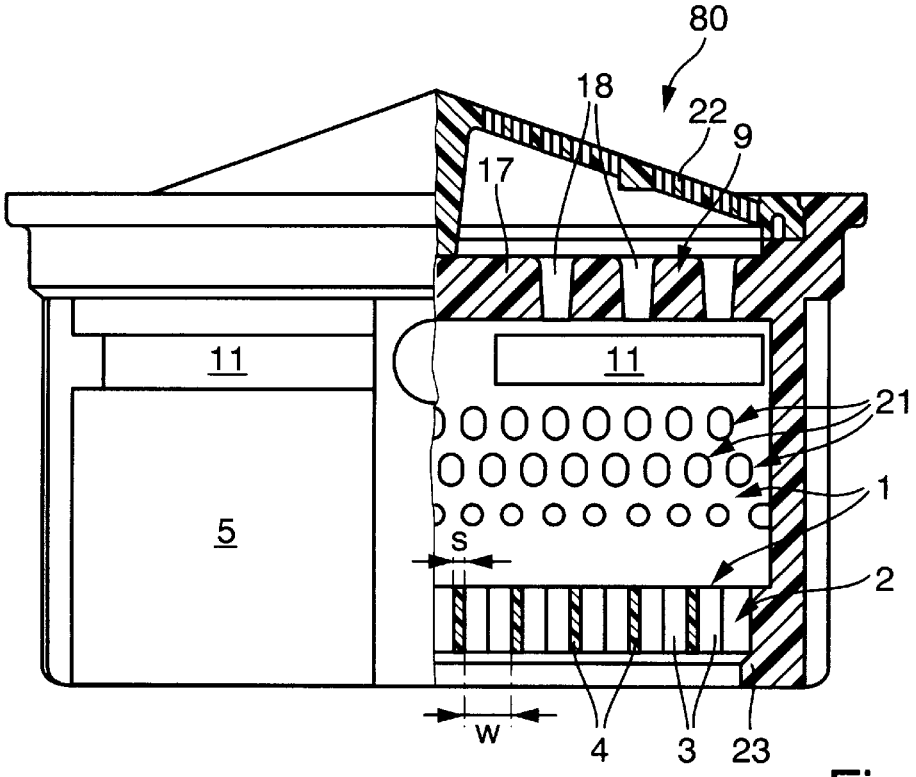
FIG. 6 is a partial longitudinal section of a flow regulator that has a flow regulation device that is essentially made out of several layers of pins arranged in a grid-shaped manner relative to each other, and the outlet side includes a honeycomb-like perforated plate.

From the longitudinal sections in FIG. 1*b* to 4*b*, as well as from the FIG. 5 and 6, it is clear that the ratio h to D between the height h of the guide walls and the overall diameter D (see FIG. 1*b*) of the flow regulation devices 10, 20, 30, 40, 70 and 80 is smaller than 1. Preferably, a ratio of h to D that is smaller than 3 to 21, and preferably in the range 1.5 to 15 up to 2 to 21 is desired. In spite of the comparatively small height h of the guide walls relative to the total diameter D of the perforated plate, the separate streams are sufficiently guided in the flow regulation device 1 in order to then be able to be combined on the outlet face into a bubbling soft homogeneous unified stream.

It is especially advantageous when the flow-through holes 3 of the perforated plates 2 have an internal hole diameter or a width across corners of 0.5 mm to 2.5 mm. For example, the guide walls 4 of the flow regulators 10 to 80 depicted here each have a wall thickness s of approximately 0.25 mm, and the flow-through holes have an internal hole diameter w of approximately 1.25 mm. This hole diameter is dimensioned such that the contaminant particles carried in the water pass through the flow-through holes 3 and cannot impair the function of the flow regulation device 1.

The flow-through holes 3 can have a round, rounded (for example, elliptical), circular segment-like or angular hole cross-section. An embodiment form is preferred in which the hole cross-sections of the flow-through holes—as here—are constructed hexagonally such that the sides of the flow-through holes that border each other are arranged approximately parallel to each other.

The flow-through holes 3 provided in the hole plate 2 of the flow regulator 10 to 80 have, because of the guide walls 4 that limit them, a longitudinal extension that enables the separate water streams to form better due to the longer acting adhesion forces. Since the flow-through holes 3 are separated from each other at the same time only by the thin guide walls 4 and lie correspondingly close to each other, the separate streams unite after passing through the flow regulation device 1 into a homogeneous, bubbling, soft non-spraying full water stream.

Figure 2A:
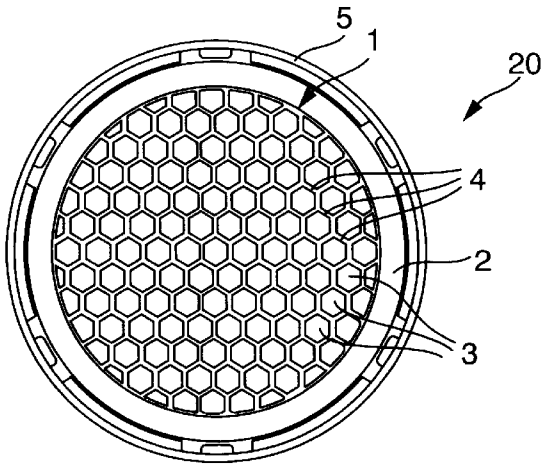
FIG. 2*a* is a bottom view of a flow regulator similar to FIG. 1*a;*
Figure 2B:
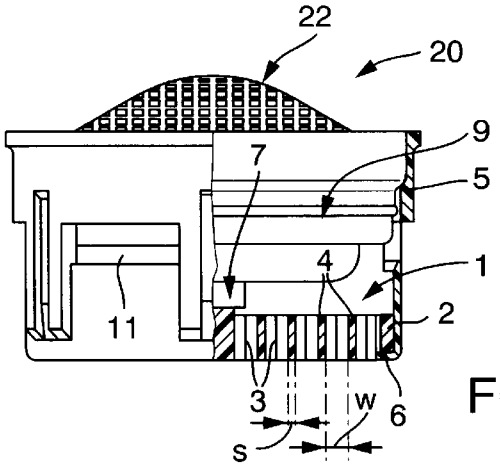
FIG. 2*b* is a partial longitudinal section where the perforated plate of the flow regulation device is constructed here as a separate insert part and can be inserted into the flow regulator housing.
Figure 4A:
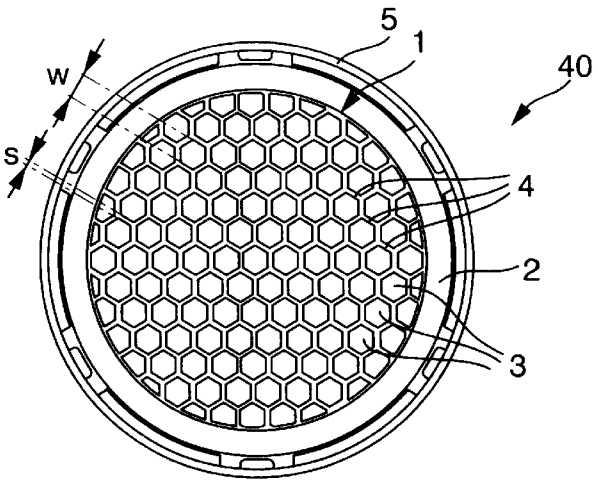
FIG. 4*a* is a bottom view of a flow regulator similar to FIG. 3*a;*
Figure 4B:
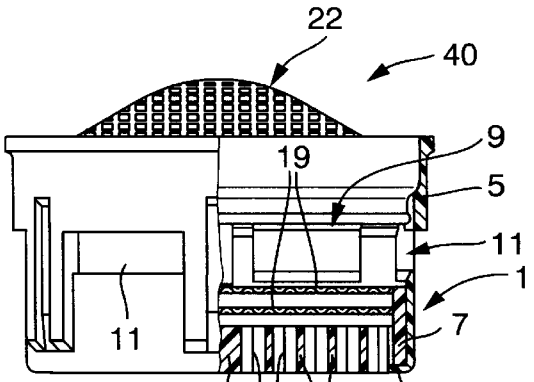
FIG. 4*b* is a partial longitudinal section in which the perforated plate of the flow regulation device here can be constructed as a separate insert part and can be inserted into the flow regulator housing.
Figure 3A:
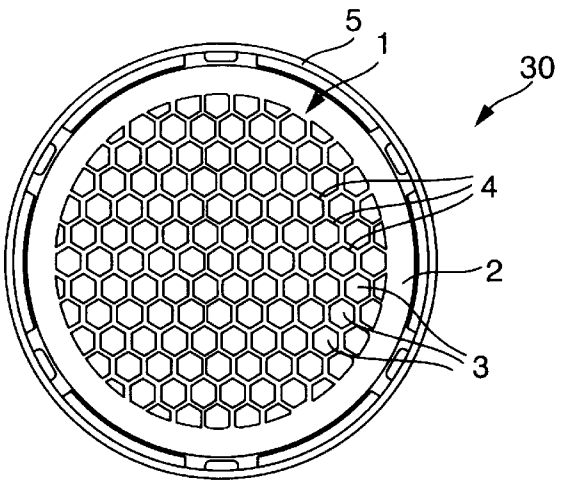
FIG. 3*a* is a bottom view of a flow regulator similar to those from FIGS. 1*a* and 2*a;*
Figure 3B:
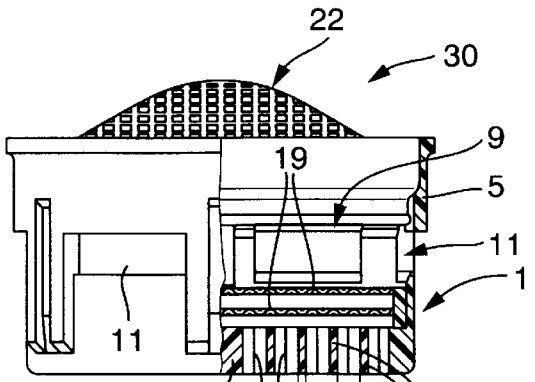
FIG. 3*b* is a partial longitudinal section in which the flow regulation device of this flow regulator has two flow regulator sieves which are connected upstream of the honeycomb-like perforated plate connected as a single piece with the flow regulator housing in the flow direction.

In this way, the perforated plate 2 of the flow regulation devices 1 can, for example, be manufactured as an injection molded or extruded part from plastic or any other suitable material in a cost-effective manner. Whereas in the flow regulators 10, 30 and 80 according to FIG. 1, 3 and 6, the perforated plate 2 is formed as a single piece with the flow regulator housing 5 and forms its outlet side face, the perforated plate 2 used in the flow regulators 20, 40 and 70 according to the FIG. 2, 4 and 5 is formed as a separate insert part in the flow regulator housing 5. On the inner housing case of the flow regulator housing 5, a support constructed as a ring flange 6 is provided for this purpose. The perforated plate 2 can be mounted on it coming from the incoming flow side housing opening. In order to make the handling of a separate perforated plate of this type easier, it is advantageous when the perforated plate 2 has a non-perforated outer ring zone that functions as a mounting area.

The simple manufacture of the perforated plate 2 is further simplified when the perforated plate 2 has several ejector points or molded-on ejector parts—not shown further here—in the area of its honeycomb cell-like perforated field. These points or parts are preferably circular in shape and are preferably arranged at equal distances from each other.

In FIG. 1 as well as in particular in FIG. 2, 4 and 5, it is recognized that between the perforated plate 2 and a pre-connected element of the flow regulators 20, 40 and 70, a spacer 7 is provided which ensures the distance between the perforated plate 2 and the adjacent element in a direction opposite to the flow direction. Since the elements that are connected upstream in the flow direction are held at a defined distance by additional spacers and since the first element on the inflow side rests on the nozzle edge of the outlet fitting not shown here, the elements inserted into the flow regulator housing 5 including the perforated plate 2 can not be pushed, in the flow regulators 20, 40 and 70, to the top opposite the flow direction in an unintended way.

In a similar manner as the perforated plate 2 connected with the flow regulator housing 5 as a single piece for the flow regulators 10, 30 and 80, the perforated plate 2 inserted as a separate structural part ensures the corresponding flow regulators 20, 40 and 70 from unauthorized manipulations.

In FIG. 5 it is depicted that the three molded-on ejector parts provided on the perforated plate 1 simultaneously function as spacers 7. These molded-on ejector parts, of which in FIG. 5 only two are to be seen, are arranged on a circular path at equal distances from each other on the inflow side of the perforated plate 1. The perforated plate 2 of the flow regulator 70 depicted in FIG. 5 can, if necessary, also be molded on as a single piece to the flow regulator housing 5.

The flow regulators 10, 20, 30, 40, 70 and 80 depicted in FIG. 1, 2, 3, 4, 5 and 6 each have a flow dispersion device 9, which divides the in flowing water into several separate water streams. These separate water streams are then, after they have been blended with the air penetrating via the housing openings 11, formed in the subsequently connected flow regulation device 1 on the outflow side into a bubbling soft homogeneous unified stream.

The flow regulators 10 to 40 and 70 and 80 depicted in FIG. 1 to 6 are provided with air admixture. The perforated plate 2 of the flow regulation device 1 can, however, also be inserted in an advantageous way, in such flow regulators and equivalent sanitary outlet devices which do not have air admixture.

With the flow regulation device 1 depicted here, all known flow dispersion systems can be combined in an advantageous way. Thus, in the flow regulator 70 according to FIG. 5, the flow dispersion device 9 can be constructed as a deflector distribution system which has on the inflow side a cylindrical recess 13. This cylindrical recess 13 is limited by a ring wall 14 that extends in the axial direction, which has open flow-through openings 15 arranged in a star-shape on the inflow side. These flow-through openings 15 open in an outer ring zone area 16, through which the water streams can flow to the flow regulation device 1.

As opposed to this, the flow regulator 80 according to FIG. 6 has a flow dispersion device 9 constructed as a perforated plate system that is free of a deflector surface. Whereas for the flow dispersion device according to FIG. 5 an effective stalling of the water flow is characteristic, the flow dispersion device according to FIG. 6 is characterized by a small noise development that is in accordance with the standard.

The flow dispersion device 9 of the flow regulator 80 according to FIG. 6 has a flow dispersion plate 17 constructed as a perforated plate having uniformly distributed and here, round flow-through openings 18 provided through the planar surface which is arranged crosswise to the flow direction.

When, for example, for perforated plate systems of this type, the speed of the inflow water is not sufficiently reduced, it can be advantageous when preferably several flow regulator sieves 19 are connected before the perforated plate 2 of the flow regulation device 1. Thus, the flow regulation device 1 of the flow regulators 30 and 40 according to FIG. 3 and 4 have two flow regulator sieves 19 separated from each other and from the perforated plate 2, which cause a pre-regulation and a uniform distribution of the separate streams.

The flow regulator 80 according to FIG. 6 represents, on the other hand, a preferred embodiment. Here, the flow regulation device 1 has pins 21 or stays running crosswise to the flow-through direction, which are connected upstream of the perforated plate 2 of the flow regulation device 1. These pins 21 arranged respectively parallel to each other are arranged next to each other in a grid shape in three planes oriented crosswise to the flow-through direction. The pins 21 of the three pin layers are arranged crosswise to the flow direction laterally offset, such that the pins 21 of the respective pin layers arranged downstream are arranged in the flow path formed by the pins 21 of the adjacent upstream pin layer. In this way, the separation distance of adjacent pins 21 of a pin layer is approximately equal.

The pins 21 have a rounded, flow-encouraging cross-sectional profile, where the pins 21 of the two upper pin layers have an oblong cross-sectional profile.

As is apparent from FIG. 6, the pins 21 of the inflow side first pin layer are arranged in the flow direction to the hole axes of the flow-through openings 18 provided in the flow dispersion plate. The flow-through openings 18 in the flow dispersion plate 17 are constructed to narrow conically in the flow-through direction and have on the inflow side an intake radius or intake cone. In this way, the pins 21 also functioning for the pre-regulation can be connected as a single piece with the flow regulator housing 5 and are also constructed out of plastic. The flow regulator 80 depicted in FIG. 6 can thus be manufactured from only one material and can be removed in a correspondingly simple manner, and made available for reuse of the plastic material. Therefore, the flow regulation device 1 consisting of the pins 21 oriented crosswise to the flow direction and the perforated plate 2 has less of a tendency to calcify than occurs in traditional flow regulation sieves, especially in the intersection points of the grid network structure of the individual sieves. By the pins 21 oriented crosswise to the flow direction, as well as the perforated plate 2 of the flow regulator 80, a sufficient flow regulation can be achieved even at high liter outputs in order to ensure a noise development that is in accordance with the standard.

For the flow regulators that are round in cross-section, it can be advantageous when the flow-through holes 3 of the perforated plate 2 arranged on the outer ring zone are formed in a deformed manner on the outside into a circular shaped sheath circuit that defines the perforated field. In this way, undesired flow obstructions are also avoided in the edge area of the perforated plate 2.

As the FIG. 1 to 4 as well as 6 show, the flow regulators 10 to 40, as well as 80, depicted there, have an attachment sieve 22, which is arranged on the inflow side prior to the flow regulation device 1 as well as the flow dispersion device 9. This attachment sieve 22 should filter out the contaminant particles possibly carried along in the water and ensure the functioning of the flow regulator 10 to 40 and 80.

The flow regulators 10 to 80 depicted here can be manufactured with a comparatively small expense. Because of the perforated plate 2 of their flow regulation device 1 constructed in honeycomb cell-like manner, the flow regulators 10 to 80 characterize themselves by an especially good flow formation and a high functional reliability.

The flow regulators depicted here have a round cross-section. It is also possible, however, to manufacture such outlet devices using an oval or similar rounded outline, a circular segment-type or an angular outline. In addition to or instead of this, at least one honeycomb cell-type perforated field can be provided in the perforated plate 2, which has a round, rounded, circular segment-like or angular outline.

Figure 7:
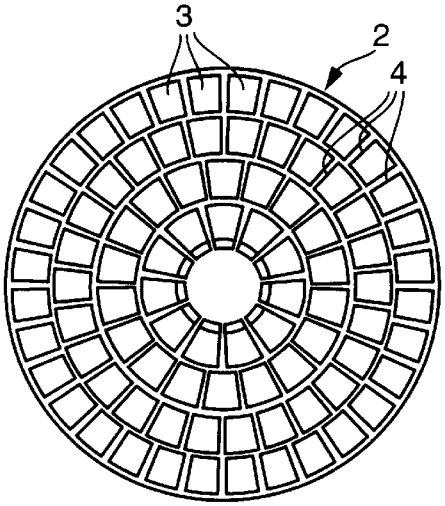
FIG. 7 is a bottom view of the perforated plate of a flow regulator which functions as a flow regulation device, where the perforated plate has circular segment-type flow-through holes.

Thus, in FIG. 7, the perforated plate 2, which fimctions as an outlet side flow regulation device, of an otherwise not further depicted sanitary outlet device, is shown. The perforated plate 2 in FIG. 7 has flow-through holes 3, which have a circular segment-type internal flow-through cross-section. The circular segment-type flow through holes 3 are arranged on several concentric ring areas. In this way, the flow-through holes 3 set off at distances uniformly from each other are separated by thin guide walls 4 that have a wall thickness that amounts to only a fraction of the internal hole diameter of a flow-through hole 3 limited by the guide walls 4.

Figure 8:
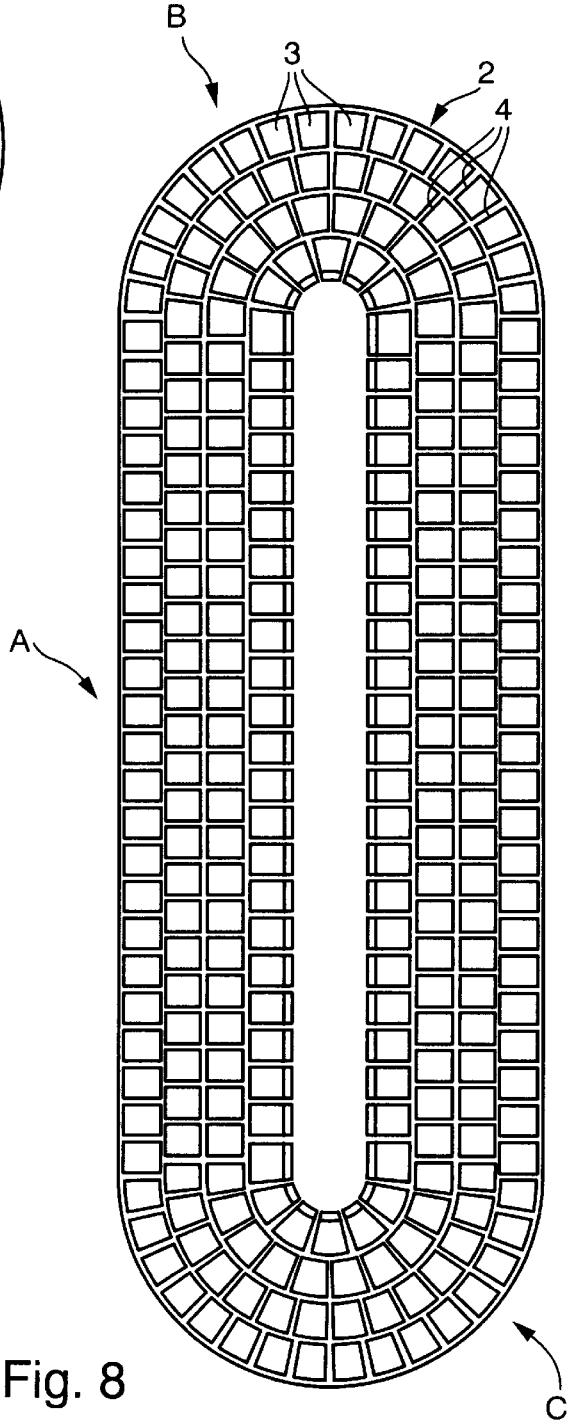
FIG. 8 is a bottom view of the perforated plate of the flow regulation device where the flow regulator here has a longitudinally extended, rounded outline.

In FIG. 8 the perforated plate 2 of a sanitary outlet device is shown, which has a longitudinally extended rounded outline here. The perforated field of the perforated plate 2 in FIG. 8 is formed by flow-through holes 3 that have in the middle area A of the perforated plate 2 a right angled flow through cross-section, whereas the flow-through holes provided in the semi-circular shaped end areas B and C of the perforated plate 2 have a circular segment-type flow-through cross-section. Using the outlet device depicted in FIG. 8, a wide water stream can be formed, which is made homogeneous and bubbling soft over its entire stream width.

It will be appreciated by those skilled in the art that changes can be made to the embodiments described above without departing from the broad inventive concept. It is understood, therefore, that this invention is not limited to the particular embodiments disclosed, but it is intended to cover modifications within the spirit and scope of the present invention.

What is claimed:

1. A flow regulator comprising a flow dispersion device (9) which divides water flowing through the flow dispersion device (9) into several separate water streams and a flow regulation device (1) that forms a face of the flow regulator on an outlet side and is connected downstream in a flow direction and has a perforated plate (2) on the outlet side constructed as a perforated field of a planar surface that is oriented transversely to the flow direction, the perforated plate (2) has several flow-through holes (3) having a generally hexagonal flow-through cross-section extending over the entire planar surface, the flow-through holes (3) are defined by guide walls (4) that separate adjacent flow-through holes from each other and that extend in approximately the flow direction, each guide wail has a wall thickness (s) which amounts to a fraction of an internal cross-sectional width (w) of one of the flow-through holes (3) defined by the guide walls (4), the flow dispersion device (9) and the flow regulation device (1) being arranged in a flow regulator housing of the flow regulator, a ratio h to D between a height (h) of the guide walls (4) and a total diameter (D) of the flow regulation device (1) is smaller than 3 to 21, and on the flow outlet side of the flow regulator housing downstream of the flow regulation device (1), a housing constriction (23) for stream narrowing is provided.

2. Flow regulator according to claim 1, wherein the guide walls (4) defining the flow-through holes (3) have the outlet side edges which are rounded.

3. Flow regulator according to claim 1, wherein the wall thickness (s) of the guide walls (4) is from 0.2 mm to 1 mm.

4. Flow regulator according to claim 1, wherein an internal width across comers (w) of the flow-through holes (3) is from 0.5 mm to 2.5 mm.

5. Flow regulator according to claim 1, wherein the flow dispersion device (9) has at least one flow dispersion plate (17) with flow-through openings (18).

6. Flow regulator according to claim 1, wherein the flow regulation device (1) has at least one flow regulator sieve (19), which is located on an inflow side of the perforated plate (2).

7. Flow regulator according to claim 1, wherein the perforated plate (2) is an integral component of a flow regulator housing and the perforated plate (2) is connected in a single piece to the flow regulator housing.

8. Flow regulator according to claim 1, wherein the perforated plate (2) is detachably connected to the flow regulator housing and a support is constructed on an inside of the flow regulator housing as a ring flange (6) on which the perforated plate (2) can be set from an inflow side of the flow regulator housing.

9. Flow regulator according to claim 1, wherein the perforated plate (2) has a non-perforated outer ring zone that functions as a mounting area.

10. Flow regulator according to claim 1, wherein between the perforated plate (2) and a pre-connected element of the flow regulator at least one spacer (7) is provided, which ensures a separation distance of the perforated plate (2) and the pre-connected element of the flow regulator.

11. Flow regulator according to claim 1, wherein between the perforated plate and a pre-connected element of the flow regulator, a positioning aid is provided which has a positioning opening on the one element of an outlet device into which a positioning projection provided on the other element dan be inserted.

12. Flow regulator according to claim 1, wherein the flow regulation device (1) has stays or pins (21) running crosswise to the flow-through direction, which are located upstream of the perforated plate (2) of the flow regulation device (1).

13. Flow regulator according to claim 12, wherein the pins (21) are arranged in an approximately radial manner, offset at a distance from each other in the flow direction.

14. Flow regulator according to claim 12, wherein the pins (21) are arranged parallel to each other and are arranged next to each other in a grid shape in at least one plane oriented crosswise to the flow-through direction, and that several pin layers are arranged above each other in planes set apart at a distance in the flow-through direction.

15. Flow regulator according to claim 12, wherein at least two adjacent pin layers having laterally offset pins (21) are arranged crosswise to the flow-through direction and the pins (21) of a downstream pin layer are arranged in the flow path formed by the pins (21) of an adjacent upstream pin layer.

16. Flow regulator according to claim 12, wherein a separation distance of adjacent pins (21) of a pin layer is approximately equal.

17. Flow regulator according to claim 16, wherein a separation distance of adjacent pin layers arranged on an incoming flow side is smaller than a separation distance of adjacent pin layers arranged downstream and the pin layer located on the outlet side has pins (21) with a center distance from each other, and from pins (21) of the adjacent pin layer, of more than 0.8 mm.

18. Flow regulator according to claim 12, wherein the pins (21) have a flow-encouraging cross-sectional profile selected from and selected from one of a circular, a rounded cross-sectional profile, an oval, drop-shaped, or similar oblong cross-sectional profile with a longer cross-sectional extension in the flow-through direction.

19. Flow regulator according to claim 12, wherein three pin layers are connected upstream from the perforated plate (2) of the flow regulation device.

20. Flow regulator according to claim 5, wherein the throughput openings (18) in the flow dispersion plate (17) are constructed to narrow in- a cylindrical or conical manner in the flow-through direction and have an incoming flow side, an intake radius or intake cone.

21. Flow regulator according to claim 20, wherein the pins (21) of a first pin layer on the inflow side are arranged approximately in the flow direction in alignment to the hole axes of the throughput openings (18) in the flow dispersion plate (17).

22. Flow regulator according to claim 1, wherein the flow regulator is equipped with air suction openings.

23. Flow regulator according to claim 1, wherein the perforated plate has in the area of the hexagonal flow-through holes, several molded-on ejector parts which define a spacer element (7), wherein the molded-on ejector parts are generally circular in shape and arranged at equal distances from each other.

24. Flow regulator according to claim 23, wherein the spacer element 7 is located between the perforated plate (2) and an upstream element of the flow regulator.

* * * * *